US005320285A

United States Patent [19]

Lu

[11] Patent Number: 5,320,285

[45] Date of Patent: Jun. 14, 1994

[54] GRINDING MIXER

[76] Inventor: Tsai-Chuan Lu, No. 560, Dong-Yi Road, Chiayi City, Taiwan

[21] Appl. No.: 107,992

[22] Filed: Aug. 18, 1993

[51] Int. Cl.[5] ..... B02C 18/08; B02C 18/10

[52] U.S. Cl. ..... 241/46.01; 241/46.017; 241/46.11; 241/84

[58] Field of Search ..... 241/46.01, 46.17, 46.11, 241/46.017, 84

[56] References Cited

U.S. PATENT DOCUMENTS

| | | | |
|---|---|---|---|
| 1,768,735 | 4/1929 | Beers | 241/46.01 |
| 2,541,221 | 2/1951 | Edwards | 241/46.017 |
| 2,578,805 | 12/1951 | Johnson | 241/46.11 |
| 2,619,330 | 11/1952 | Willems | 241/46.017 |
| 2,963,281 | 12/1960 | Reiffen | 241/46.17 |
| 3,071,353 | 1/1963 | Klein et al. | 241/46.017 |
| 3,894,694 | 7/1975 | Rothman | 241/46.11 |

*Primary Examiner*—Mark Rosenbaum
*Assistant Examiner*—John M. Husar
*Attorney, Agent, or Firm*—Bacon & Thomas

[57] ABSTRACT

The grinder is generally composed of a cantilever having one end supported by a stand and the other end of which being connected with a spindle, perpendicularly. A grinding means is secured to the bottom end of the spindle adopted to grind and to mix articles evenly.

2 Claims, 7 Drawing Sheets

GRINDING MIXER

FIELD OF THE INVENTION

This invention relates to a grinding mixer. More particularly, a mixer adopted to grind material having lager particles, such as paint, dye . . . etc., into smaller particles, and in the meantime to mix them evenly.

BACKGROUND OF PRIOR ART

There is a restricted requirement in the field of chemical industry that material such as paint, or dye is to be ground to a very fine quality. The grinding machine of the prior art uses shot peening machine, as shown in FIGS. 5, 6, which includes generally a cylindrical barrel A having a spindle B rotatably attached therein. A plurality of blades C is equally spaced along the spindle B adopted to roll glass balls enclosed within the barrel A to grind material being feeded into the barrel A through feeding entrance D. The material after grinding flown out through exits F, G.

However, the machine utilizes an instant strike of any two balls to grind the material that will take times to reach the fine requirement. Further, the spinning of the spindle will create a high speed to the glass balls that may break the balls. Sometimes, the quality of grinding is poor, as shown in FIGS. 7, 8.

In view of this, the inventor has invented the present invention which takes less time to process the grinding procedure and which produce a better quality.

SUMMARY OF THE INVENTION

It is the primary object of the present invention to provide a grinding mixer which utilizes grinding bars and a grinding seat to grind material, and therefore illuminates the possibility of broken glass.

It is another object of the present invention to provide a grinding mixer which is able to grind the material to the finest possible.

It is still an other object of the present invention to provide a grinding mixer which grinding space is adjustable to grind the material to finest requirement.

It is a further object of the present invention to provide a grinding mixer which is able to mix the material along with the grinding procedure.

It is still a further object of the present invention to provide a grinding mixer which feeds material to be ground into its grinding space in an auto maner without any other extra equipment.

DETAILED DESCRIPTION OF THE PREFERRED EMBODIMENT

Figure 1:
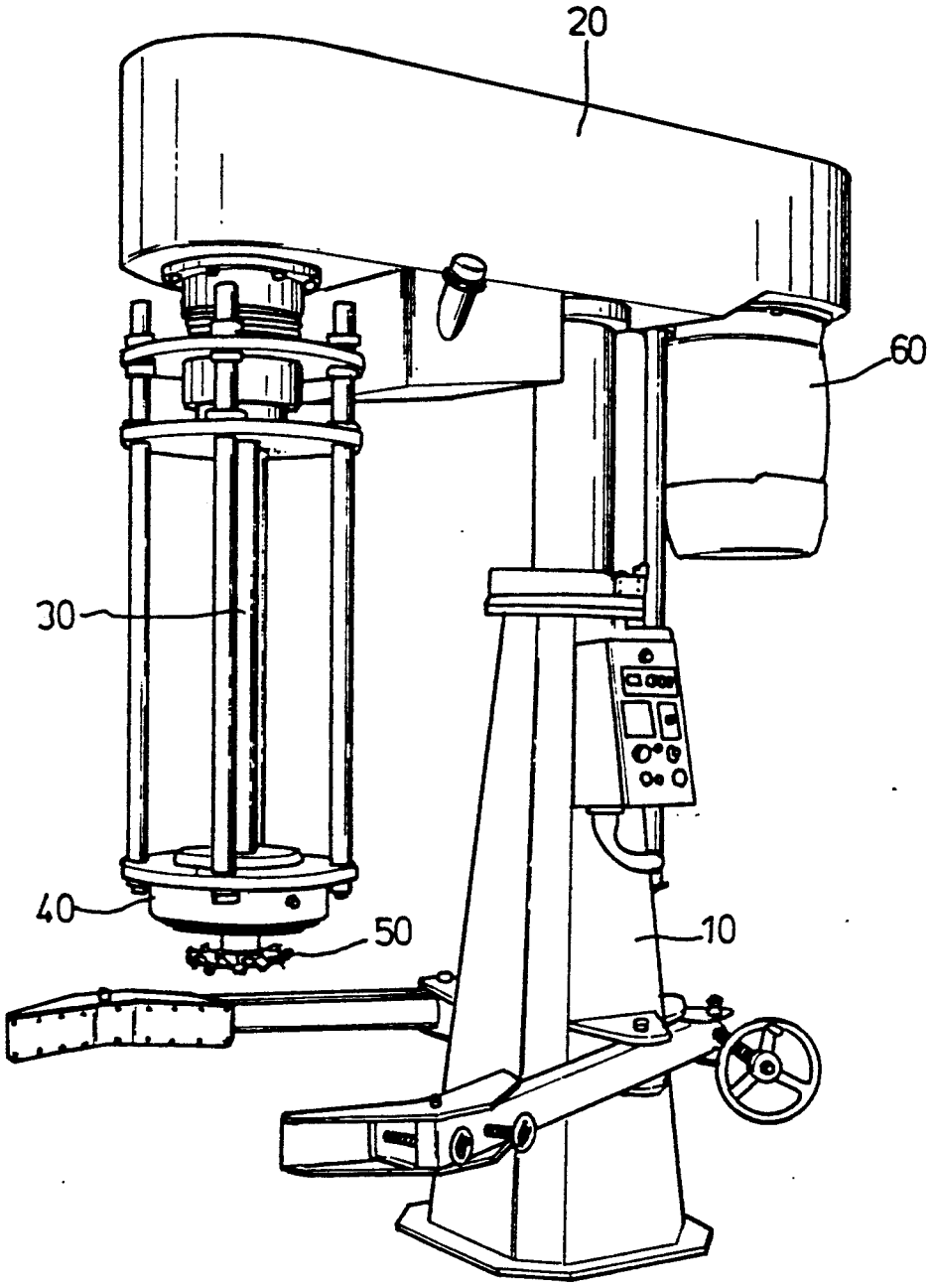
FIG. 1 is a perspective view of the present invention.
Figure 2:
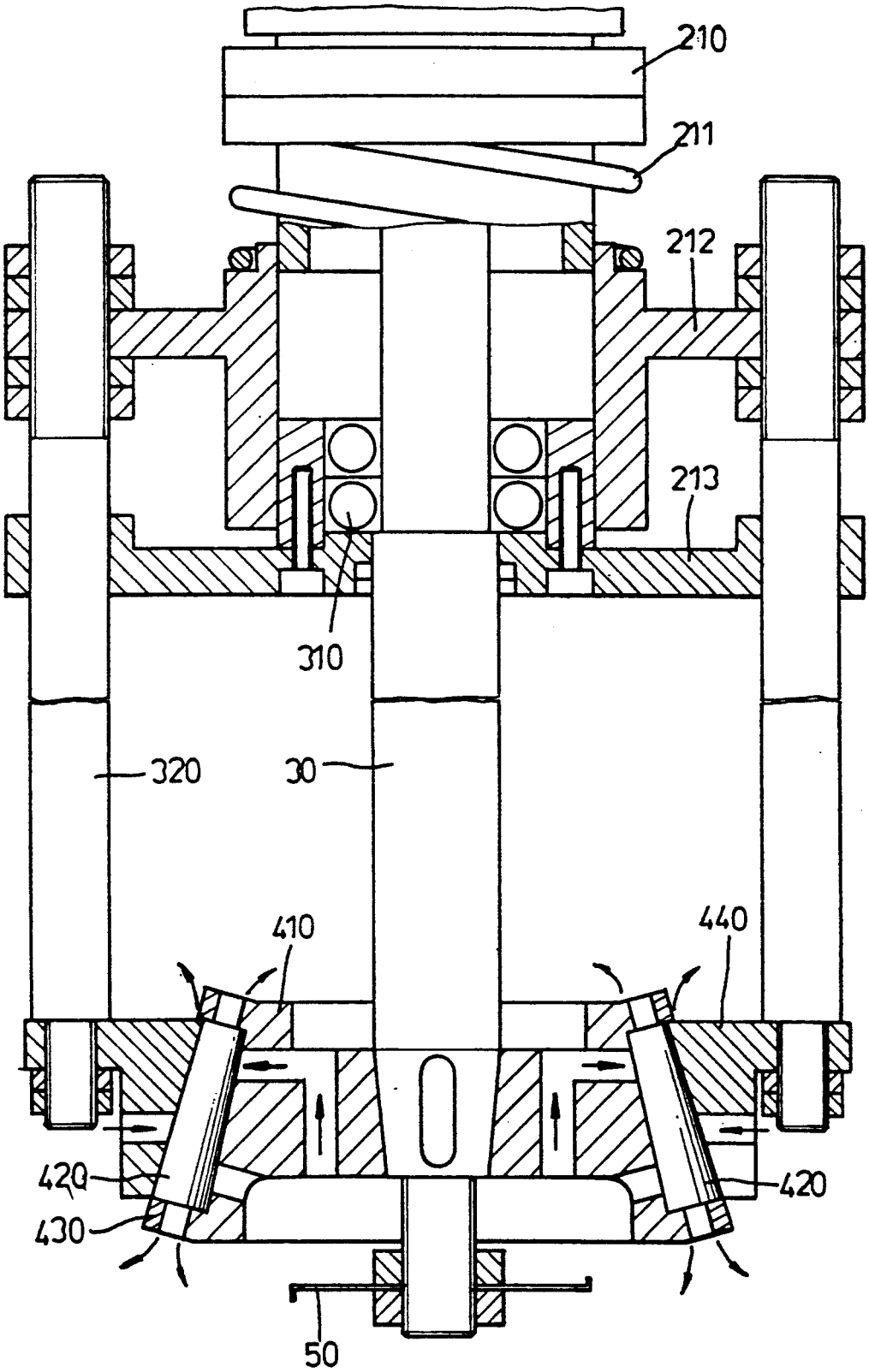
FIG. 2 is an enlarged view of a grinding means of FIG. 1, showing material feeding into and extracting out of the present invention, having partially sectioned.
Figure 3:
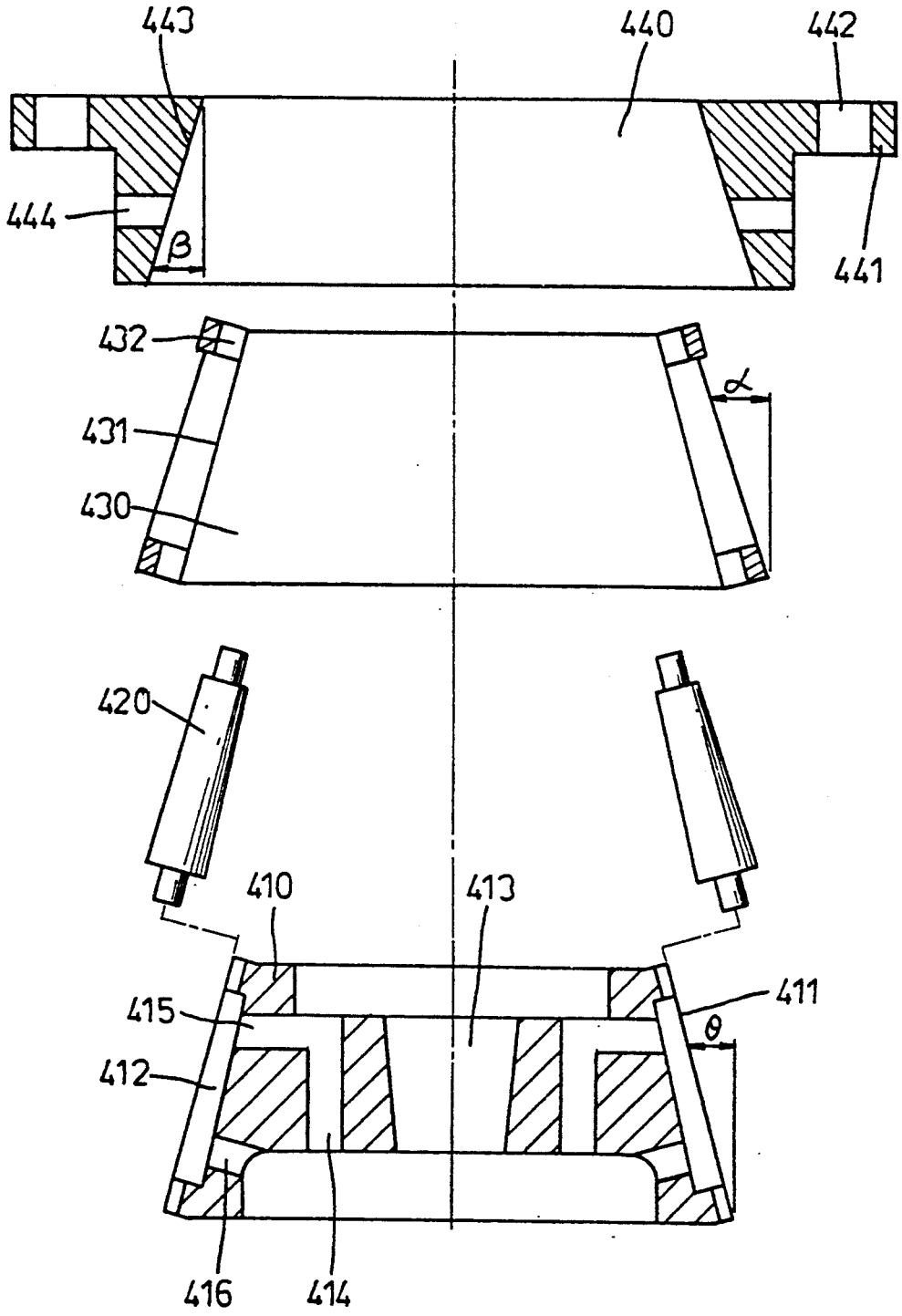
FIG. 3 is a part breakdown of FIG. 2.

Referring now to the drawings, in particular to FIGS. 1, 2 and 3, the mixer is generally composed of a stand 10, a cantilever 20 having one end secured to the top of the stand 10 and the other end of which connected with a spindle 30 rotatably controlled by a motor 60, a grinding means 40 connected to the bottom of the spindle 30, and blades connected to the extremity thereof.

A balancer 210 includes a spring 211 seating on top of a fixture 212, and sleeves on the spindle 30 to provide a predetermined pressure to the spindle 30 for grinding purpose. A disc 213 stands underneath the fixture 212.

The spindle 30 rotatably connected to the cantilever 20 has a bearing 310 seating on the disc 213.

The grinding means 40 located at bottom portion of the spindle 30 includes an inner sleeve 410, at least one grinding bar 420, a grinding seat 430, and an outer sleeve 440. The outer wall 411 of the inner sleeve 410 inclines to an angle which wall along with the grinding bar 420 has formed a groove 412. An aperture 413 at center thereof is adopted for the spindle 30 to insert therethrough. A plurality of through holes 414 are formed at the periphery of the aperture 413. Each through hole 414 has a pair of entrances 415, 416 one at top and one at bottom portions thereof and connected to the outer sleeve 440, respectively. The grinding bar 420 shaped like a corn having 24 pieces which is the best number to perform the grinding job. The grinding seat 430 has an inclining outer wall, a hollow body having an inner diameter slightly larger than the outer diameter of the inner sleeve 410 so that inner sleeve 410 is receivable therein, and a plurality of grooves 432 at top portion thereof adopted to receive grinding bars 420 therein. The outer sleeve 440 has plurality of supports 320 being inserted through the disc 213 and standing on the outer sleeve, and a ring 441 protruding outwardly therefrom. The ring 411 is divided into four segments by four notches 442, respectively. The outer sleeve 440 has a hollow body with its inner wall inclined in an angle, and four entrances 444 which forming an angle of approximately 45 degrees in relation to the seat 430 itself. The blades are connected to and driven by the spindle 30.

To assemble the present invention, first insert the grinding bars 420 into the groove 412 of the outer wall 411 of the inner sleeve 410. Sleeve the grinding seat 430 thereon allows the grinding bars 420 to rest in the groove 432, and covered with the outer sleeve 440 that has completed the assembling procedure.

Figure 4:
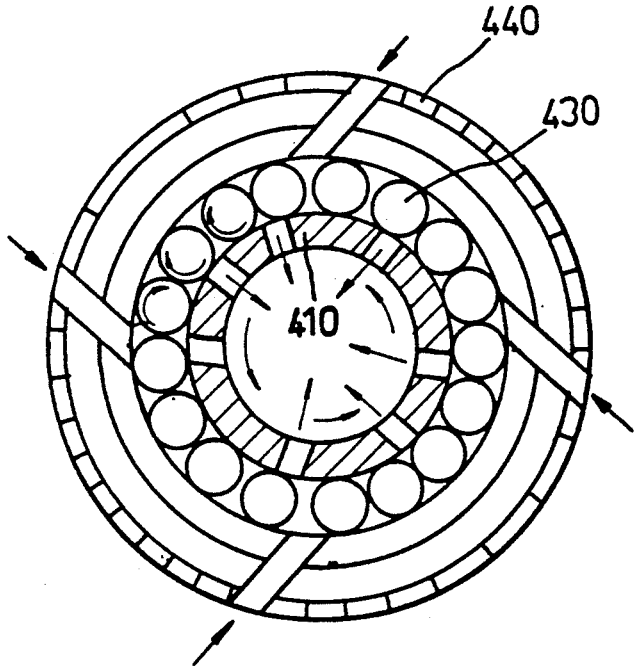
FIG. 4 is a top view of FIG. 2, partially sectioned.
Figure 5:
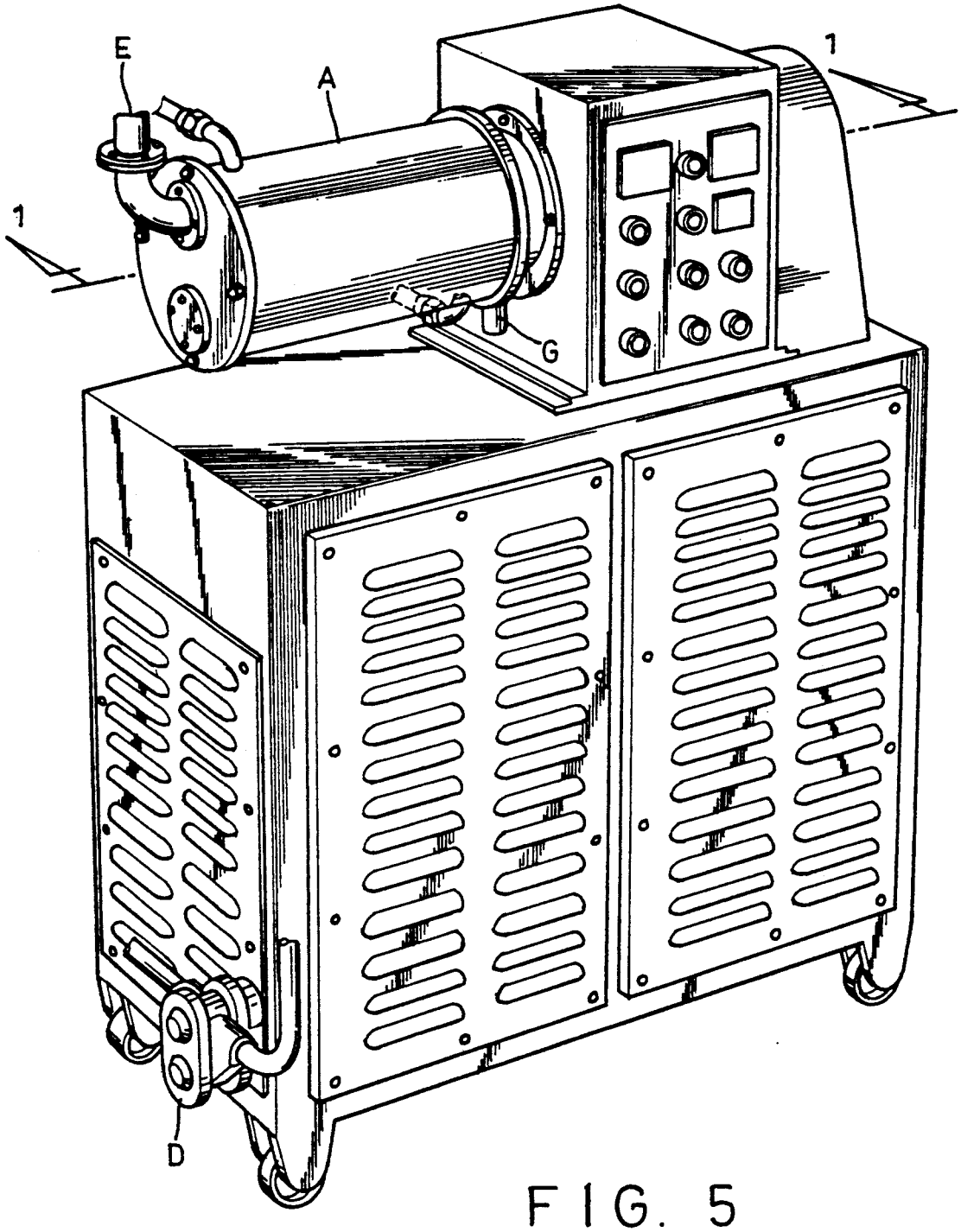
FIG. 5 (PRIOR ART)
FIG. 5 is a perspective view of prior art.
Figure 6:
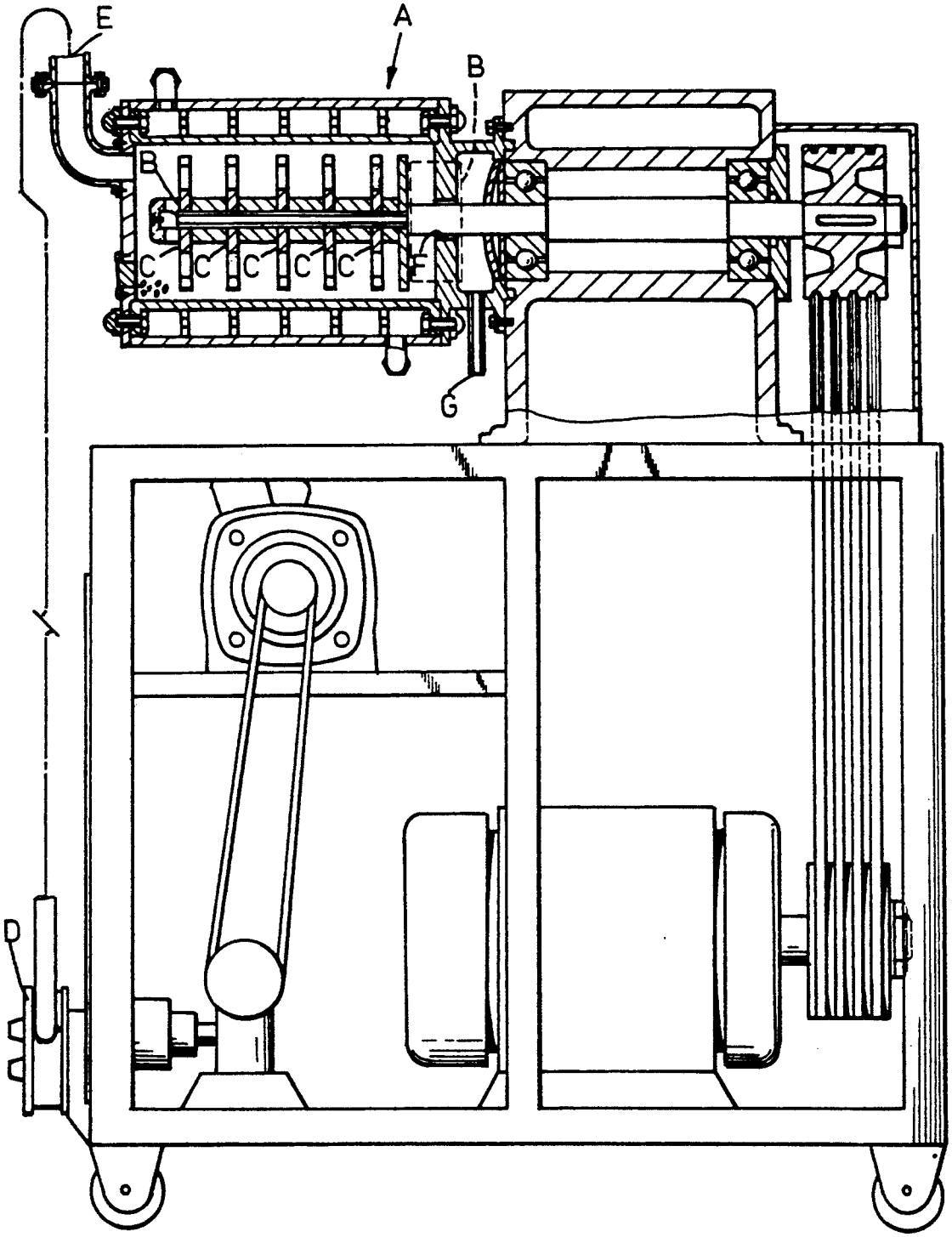
FIG. 6 (PRIOR ART)
FIG. 6 is a side view of FIG. 5, partially sectioned.
Figure 8:
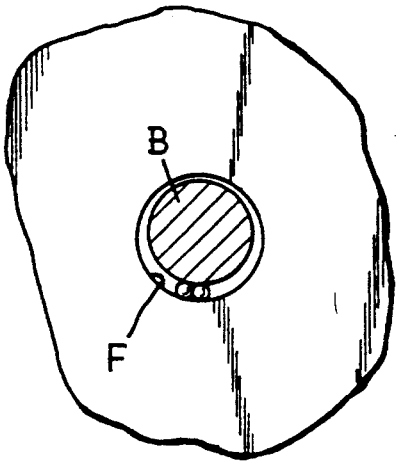
FIG. 8 (PRIOR ART)
FIG. 8 is a sectional view, taken along line C—C of FIG. 7.
Figure 7:
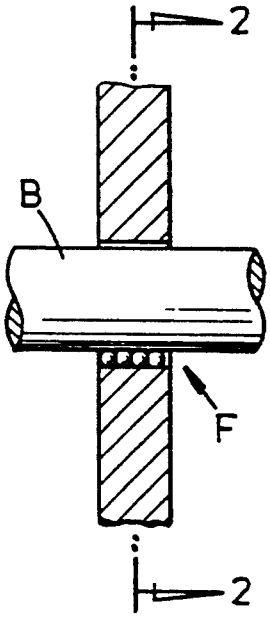
FIG. 7 (PRIOR ART)
FIG. 7 is an enlarged view taken along a phantom line of FIG. 5.

In operation, place material barrel underneath the grinding means 40 and insert the grinding bars 420 and the blades 50 into the barrel. Start the motor 60 which drives the spindle 30 to rotate simultaneously. The spindle 30 then links the inner sleeve to rotate. The inner sleeve 410 will link the grinding bars 420 to spin in a opposite direction, as shown in FIGS. 3, 4. This rotation f the inner sleeve 410 and the spinning of the grinding bars 420 will produce a swirl current that will suck the material from the barrel into the grinding means 40 through entrances 415, 416, or 444. The material, after grinding, will come out of the grinding means 40 from the upper and the lower portions of the grinding bars 420.

In order to meet various requirement, the grinding space may be adjusted by lower down the balancer 210 which will force the spring 211 to depress the fixture 212, the supports 320, and the outer sleeve 440. This depression will decrease the grinding space between the inner wall of the outer sleeve 440 and the grinding bars 420. Or to raise the balancer 210 which will bring the spring 211, the fixture 212, the support 320 and the outer sleeve 440 upwardly hat increases the grinding space between the inner wall of the outer sleeve 440 and the grinding bars 420. The adjustment of the grinding decides the requirement of how fine the material is.

I claim:

1. A grinding mixer comprising;

a cantilever having one end connected to a stand and the end of which connected with a spindle perpendicularly;

a grinding means being connected to the bottom portion of said spindle having an inner sleeve, at least one corn shaped grinding bar, a grinding seat, and an outer sleeve, said inner sleeve having a slanting inner wall forming a groove thereat;

an aperture at center adapted for said spindle to insert therethrough, at least one through hole being formed around said aperture, each through hole having a pair of entrances with one at top and the other one at bottom portions thereof; said grinding seat having an inclining outer surface and a hollow body with an inner diameter slightly larger than the outer diameter of said inner sleeve at least one groove being formed on top thereof adapted to receive said grinding bar therein, said outer sleeve having a ring protruding outwardly and at least one notch thereon, a hollow body with an inclining inner wall and at least one entrance;

at least one blade being connected to the bottom of said grinding means;

a balancer securely attached to said cantilever immediately above said spindle having a spring seating on a fixture and sleeved on said spindle, a disc located underneath said fixture, a bearing resting on said disc, and at least two supports surrounding thereat.

2. A grinding mixer of claim 1, wherein said entrances of said outer sleeve are in 45 degrees with regards to said grinding seat.

* * * * *